US008833609B2

(12) United States Patent
Dobrusskin et al.

(10) Patent No.: US 8,833,609 B2
(45) Date of Patent: Sep. 16, 2014

(54) PAPER-BASED BEER CONTAINER AND DISPENSING APPRATUS THEREFOR

(75) Inventors: Christoph Dobrusskin, Eindhoven (NL); Paul Augustinus Johannes Horstman, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 603 days.

(21) Appl. No.: 12/601,331

(22) PCT Filed: May 27, 2008

(86) PCT No.: PCT/IB2008/052071

§ 371 (c)(1), (2), (4) Date: Nov. 23, 2009

(87) PCT Pub. No.: WO2008/146240

PCT Pub. Date: Dec. 4, 2008

(65) Prior Publication Data

US 2010/0206900 A1 Aug. 19, 2010

(30) Foreign Application Priority Data

May 30, 2007 (EP) ..... 07109161

(51) Int. Cl.
*B67D 1/04* (2006.01)

(52) U.S. Cl.
USPC ..... 222/95; 222/105; 222/146.6; 222/399; 222/183; 222/386.5

(58) Field of Classification Search
USPC ..... 222/95, 105, 399, 400.7, 183, 386.5, 222/464.1; 229/117.27; 62/3.64
See application file for complete search history.

(56) References Cited

U.S. PATENT DOCUMENTS 3,063,841 A * 11/1962 Ash ..... 426/416
3,298,575 A * 1/1967 Larsen ..... 222/399

(Continued)

FOREIGN PATENT DOCUMENTS

JP 60-112499 A 6/1985
JP 60-163271 U 10/1985

(Continued)

*Primary Examiner* — Paul R Durand
*Assistant Examiner* — Donnell Long

(57) ABSTRACT

The present invention relates to a self supporting closed beverage container (1) of a paper based material (2) composed of a carton for comprising a low-carbonate beverage, wherein said beverage container comprises: —at least one inner liquid sealant polymeric layer (4) welded to the paper based material; and/or —an inner bag (11) for holding a beverage and which inner bag (11) has a deformable wall part which is compressible, for dispensing beverages from the container upon deformation of the flexible wall part caused by gas pressure produced by pressure means (12); and the beverage container (1) comprises: —at least one beverage delivering tube (5) having at least one flexible section, —at least one beverage outlet opening (6) through which a lower part (7) of said beverage delivering tube (5) extends to the bottom (8) of the inner beverage container (1) and the upper part of the tube extends outwards (9), —at least one gas pressure inlet opening (10); wherein said self supporting closed beverage container (1) can in an empty stage be folded by hand and beverage can be delivered through the beverage delivering tube (5) due to gas pressure fed into the beverage container (1), the tube (5) being connected with the beverage container (1) in a gas and liquid tight manner, so that beverage cannot leak from the beverage outlet opening (6) of the beverage container (1).

4 Claims, 3 Drawing Sheets

(56) References Cited

U.S. PATENT DOCUMENTS

| | | | | | |
|---|---|---|---|---|---|
| 3,349,965 | A | * | 10/1967 | Krugger | 222/80 |
| 3,373,907 | A | * | 3/1968 | Batrow | 222/399 |
| 3,613,954 | A | * | 10/1971 | Bayne | 222/61 |
| 3,687,351 | A | | 8/1972 | Kaercher et al. | |
| 3,752,362 | A | | 8/1973 | Risener | |
| 3,926,339 | A | | 12/1975 | Openchowski | |
| 4,356,937 | A | | 11/1982 | Simon et al. | |
| 5,014,886 | A | * | 5/1991 | Sams | 222/399 |
| 5,111,974 | A | * | 5/1992 | Parker | 222/399 |
| 5,199,609 | A | * | 4/1993 | Ash, Jr. | 222/94 |
| 5,411,177 | A | * | 5/1995 | Blake, III | 222/105 |
| 6,609,636 | B1 | * | 8/2003 | Petriekis et al. | 222/105 |
| 6,942,123 | B2 | * | 9/2005 | Wertenberger | 222/94 |
| 7,661,556 | B2 | * | 2/2010 | van der Klaauw et al. | 222/1 |
| 7,810,679 | B2 | * | 10/2010 | Wauters et al. | 222/399 |
| 8,056,763 | B2 | * | 11/2011 | Cook et al. | 222/105 |
| 8,172,110 | B2 | * | 5/2012 | Beine et al. | 222/105 |
| 2004/0099687 | A1 | * | 5/2004 | Magermans et al. | 222/105 |
| 2005/0023330 | A1 | * | 2/2005 | Cook et al. | 229/117.3 |
| 2005/0051573 | A1 | * | 3/2005 | Crosland et al. | 222/105 |
| 2005/0072796 | A1 | * | 4/2005 | Penfold | 222/105 |
| 2005/0236427 | A1 | * | 10/2005 | Farha et al. | 222/105 |
| 2006/0169725 | A1 | | 8/2006 | Grill | |
| 2009/0236361 | A1 | * | 9/2009 | Doelman et al. | 222/1 |
| 2011/0259916 | A1 | * | 10/2011 | Spivey et al. | 222/105 |

FOREIGN PATENT DOCUMENTS

| | | | |
|---|---|---|---|
| JP | 61-81965 | A | 4/1986 |
| JP | 63294369 | | 12/1988 |
| JP | 11035097 | | 2/1999 |
| JP | 2000168835 | A | 6/2000 |
| JP | 2002013855 | | 1/2002 |

* cited by examiner

PAPER-BASED BEER CONTAINER AND DISPENSING APPRATUS THEREFOR

BACKGROUND OF THE INVENTION

1. Field of the Invention

This invention relates to a self supporting closed beverage container of a paper based material composed of cardboard for containing a carbonated beverage. The invention further relates to a beverage dispensing device with a housing for receiving said beverage container.

2. Description of Prior Art

Carbonated beverages, such as beer, are generally stored in a keg, metal can or bottle.

A keg has a disadvantage in that in an empty stage it cannot easily be folded by hand. Thus, the storage volume of an empty keg is the same as of a full keg. Further, the production of a keg has a high vertical range of manufacture.

Although a metal beverage can is foldable by hand, a metal can suffers from the high amount of energy needed for its production. This is one reason why metal cans are withdrawn from the market for example in Germany.

Also bottles, just like kegs, cannot easily be folded by hand in an empty stage. Further, the form of a bottle does not allow a space-saving storage. Moreover, glass bottles have a higher weight compared to a beverage container of a paper based material.

Beverage containers of a paper based material are generally known and used for non-carbonated beverages such as wine. However, beverage containers of a paper based material have never been used for carbonated beverages such as beer. The main drawback for this type of paper based container is, that said container does not withstand the gas pressure of the carbonated beverage, especially if said type of paper based container is subjected to heat.

Thus, there is a need to provide a beverage container of a paper based material suitable for serving a carbonated beverage as well as avoiding at least one of the drawbacks of carbonated beverage containers mentioned before.

SUMMARY OF THE INVENTION

The object of the present invention is to provide a beverage container of a paper based material which can be used to serve a carbonated beverage.

The present invention relates to a self supporting beverage container of a paper based material for comprising a low-carbonate beverage, wherein said beverage container comprises:

- at least one inner liquid sealant layer welded to the paper based material; and/or
- an inner bag for holding a beverage and which inner bag has at least a deformable wall part which is compressible, for dispensing beverages from the container upon deformation of the flexible wall part caused by gas pressure produced by pressure means; and the beverage container comprises:
- at least one beverage delivering tube having at least one flexible section,
- at least one beverage outlet opening through which a lower part of said tube extends to the bottom of the inner beverage container and the upper part of the beverage delivering tube extends outwards,
- at least one gas pressure inlet opening; wherein said self supporting beverage container can in an empty stage be folded by hand and beverage can be delivered through the beverage delivering tube due to gas pressure fed into the beverage container, the tube being connected with the beverage container in a gas and liquid tight manner, so that beverage cannot leak from the beverage outlet opening of the beverage container.

The paper based beverage container according to the present invention can be prefolded and/or welded to facilitate any folding process, such as storage of an empty paper based container according to the present invention.

DETAILED DESCRIPTION OF THE INVENTION

Figure 1:
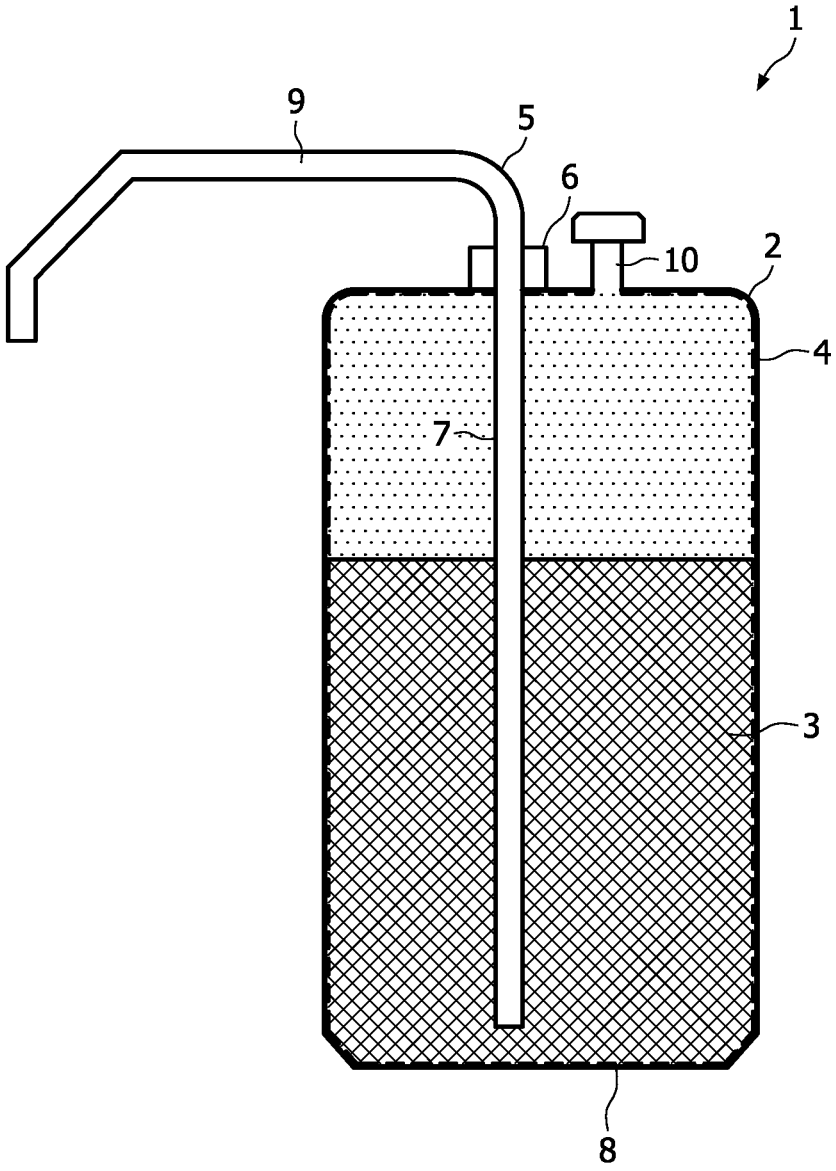
FIG. 1 is a self supporting closed beverage container according to the present invention for holding a beverage.

Before the invention is described in detail, it is to be understood that this invention is not limited to the particular component parts of the devices described or process steps of the methods described as such devices and methods may vary. It is also to be understood that the terminology used herein is for the purpose of describing particular embodiments only, and is not intended to be limiting. It must be noted that, as used in the specification and the appended claims, the singular forms "a," "an" and "the" include singular and/or plural references unless the context clearly states otherwise.

The term "low-carbonate beverage" as used according to the present invention is a beverage that has a lower carbonate concentration compared to the carbonate concentration of said beverage when ready for consumption by the consumer. A "low-carbonate beverage" is not accepted for consumption and has to be additionally carbonated before it is served to the consumer for consumption.

The term "self supporting" according to the present invention means that the empty paper based beverage container does not collapses if it stands alone.

Preferably, the self supporting beverage container of a paper based material according to the present invention has such a stiffness that it can be easily folded flat by hand. This has the advantage that the waste volume of said flat folded paper based beverage container is significantly less compared to bottles, cans or kegs.

The paper based beverage container according to the present invention can have an inner volume of at least 200 ml to about 50 l, preferably ≥300 ml, further preferably ≥500 ml and more preferably ≥1000 ml. Most preferable is that the paper based beverage container according to the present invention has an inner volume of at least 2 l to ≥25 l, for example ≥3 l to ≤10 l, or ≥5 l to ≤8 l (l=liter).

It has been found by the inventors that a paper based beverage container can withstand the gas pressure of a low-carbonate beverage. Since a low-carbonate beverage is not accepted by the consumer, the paper based beverage container according to the present invention comprises at least one beverage delivering tube and at least one gas pressure inlet opening, so that beverage can be delivered through the beverage delivering tube due to gas pressure fed into the beverage container. Further, due to the gas pressure fed the carbonate concentration of the delivered beverage is increase to the desired level as is accepted by the consumer.

According to the present invention it may be preferred that the beverage contained in the beverage container or inner bag is a low-carbonate beverage with a $CO_2$ concentration of >0 g/l and ≤1.5 g/l. However, the low-carbonate beverage may have a $CO_2$ concentration of ≥0.01 g/l and ≤1.0 g/l, preferably ≥0.05 g/l and ≤0.5 g/l and more preferably ≥0.1 g/l and ≤0.2 g/l.

Preferably, the beverage is a low-carbonate beer. A beer as it is typically served to the consumer has a $CO_2$ concentration of about 5 g/l.

The paper based beverage container according to the present invention may have an angular form such as a cuboid-like-design. The benefit is that paper based beverage containers according to the present invention having an angular form can be stored in a space-saving way.

A closed paper based container according to the present invention filled with a low-carbonate beverage with a $CO_2$ concentration of 0.05 g/l and 02 g/l (l=liter) withstands storage temperatures of up to 50° C. without leaking as a result of the low inside pressure.

The inside pressure for said low-carbonate beverage may be in the range of 0.01 bar to 0.05 bar in case of reinforced, for example multilayer, cardboard. In contrast, the pressure at about 50° C. inside a typical can filled with beer with a $CO_2$ concentration of about 5 g/l can be above 6 bars.

The paper based container according to the present invention that contains a low-carbonate beverage comprises a beverage delivering tube, a gas pressure inlet opening and/or a gas tube. The beverage delivering tube, the gas pressure inlet opening and/or the gas tube can be sealed at their outer end openings. Before use, the sealed end part can be cut off for example with a scissor. Preferably, the beverage delivering tube, gas pressure inlet opening and/or gas tube of said paper based container comprise a sealing means at their outer end openings, which has to be removed, cut, pierced and/or screwed off for opening. This allows a low vertical range of manufacture. Further, it is secured that the beverage container according to the present invention can be kept closed until the time of use, which guarantees freshness and taste of the beverage.

The gas pressure inlet opening and/or the gas tube can comprise an adapter which can be connected with a gas supply source. It may be preferred that the gas pressure inlet opening comprises a connecting element to which a gas pressure supply tube can be connected, wherein the connecting element—also called adapter—preferably comprises a screw thread, a snap fit and/or a push fit fastening.

It may be preferred that the gas pressure inlet opening is located in a central position on top of the paper based beverage container according to the present invention.

Further, it may be preferred that the beverage supply opening through which a beverage supply tube extends is located at or near the central position on top of the paper based beverage container according to the present invention.

However, it may be preferred that the beverage is not delivered from the beverage container as a result of gravitation. It is preferred that the beverage is pumped out of the container via gas pressure from an external gas pressure source.

External gas pressure source means that the gas pressure source is not located inside the paper based beverage container.

The paper based beverage container according to the present invention can have a beverage filling opening. The beverage filling opening can be used to fill up the paper based container according to the present invention via a bottling plant. The beverage filling opening is closed and sealed after the paper based container according to the present invention has been filled with the low-carbonate beverage. The gas supply opening can serve as a gas outlet opening during the filling step.

For example, the adapter can be sealed or closed but if connected with the gas supply source the sealing is removed or pierced so that a gas flow from the gas supply source into the container is provided. To avoid a gas leakage it may be preferred that the assembly of gas pressure inlet opening, adapter, gas tube and/or gas supply source is sealed.

It may be preferred that the beverage container according to the present invention comprises a gas pressure inlet opening that receives a gas tube, through which gas, preferably carbon dioxide, can be fed from a gas source, wherein the gas tube is connected with the beverage container in a gas and liquid tight manner.

To avoid confusion and for safety reasons it may be preferred that the diameter of the gas tube differs from that of the diameter of the beverage supply tube. The end opening of the beverage delivering tube and the gas tube may have different diameters as well. In addition, or as an alternative, the gas tube may comprise an adapter for connection with a gas pressure supply source with a fit that differs from the fit of the adapter of the beverage supply tube, so that the beverage supply tube cannot be connected with the gas pressure supply source.

The beverage container according to the present invention may be further improved in that the gas tube and/or the gas pressure supply tube comprises:

- at least one membrane, which is permeable to the gas and impermeable to the beverage, and/or
- at least one valve, which opens for a gas flow and stops a beverage flow, preferably the valve being an unidirectional restrictor valve.

In particular for home applications the requirements of hygiene are strict. Therefore, it is an improvement of the beverage container of the present invention that the beverage supply tube may be an integral part of the beverage container and is disposable after use.

However, there is still a danger that beverage may contaminate the gas pressure supply tube of the gas source which is not disposable. In order to avoid a contamination of the gas pressure supply tube of the gas source as well as to meet requirements as to hygiene it may be preferred that the gas opening, gas tube of said beverage container and/or the gas pressure supply tube comprise a valve and/or membrane as described above to prevent a contamination of the beverage.

In the case where the beverage container comprises an inner bag for holding a beverage, the beverage outlet opening can be arranged such that it is in contact with the beverage, and a first gas pressure inlet opening can be arranged such that it is not in contact with the beverage, so that gas pressure can be discharged between the inner wall of the beverage container and the outer wall of the inner bag. Optionally a second gas pressure inlet opening can be arrange such that it is in contact with the beverage in the inner bag, so that gas pressure can be fed into the beverage.

However, the beverage delivering tube as well as the gas pressure inlet tube has to be connected with the inner bag in a gas and liquid tight manner.

According to the present invention, during use, i.e. at the time the beverage is served to the customer, the paper based container is connected with the gas pressure supply line of the external gas source. Further, the beverage supply tube is led through the tapping device. Thus, the beverage is pumped out of the beverage container or inner bag by gas pressure. The volume loss of the beverage inside the beverage container or inner bag is replaced with the gas, so that air cannot get into the beverage container or inner bag.

For example, movement of the handle of the tapping device can actuate the gas pressure, so that gas flow is started or stopped depending on the movement of the handle. Further, the handle actuates the closing and/or opening of the beverage delivering tube, so that in a closed state no air can reach, i.e. contaminate, the beverage and beverage can only be delivered when the beverage delivering tube is open. Further, the beverage supply tube, as described below in detail, may comprises a valve that prevents an air flow from reaching the beverage inside the paper based container or inner bag of said paper based container.

The benefit of this arrangement is that the beverage, for example beer, keeps fresh and tasty over a prolonged time period and is not negatively affected by air.

The low-carbonate beverage, preferably low-carbonate beer, can be carbonated by an external gas source, such as a $CO_2$ source. Preferably, the $CO_2$ is fed into the beverage container and/or the $CO_2$ is fed into the beverage delivering tube.

The beverage container according to the present invention comprises a polymeric layer that can be selected from the group comprising a polyolefinic polymer layer and preferably a polyethylene layer.

The beverage container according to the present invention can be further stabilized against inner gas pressure. For example, a tear-proof elastic polymeric layer can be arranged as an inner layer of the beverage container wall. Said tear-proof elastic polymeric layer can be chosen such that the layer is slightly stretchable and withstands the volume expansion of the low-carbonate beverage if subjected to heat to about 50° C., i.e. the paper based container according to the present invention shall not become leaky.

Further, to increase the carbonate concentration of the low-carbonate beverage inside the container at the time of use, the paper based container can comprise at least one pressure control valve. The pressure control valve can be located inside the beverage delivering tube and/or at the gas supply line. However, the pressure control valve(s) should be arranged such that the carbonate concentration of the beverage can be increased without loss or without any significant loss. Further, if a pressure control valve is arranged at the beverage supply line, a movement of the handle will actuate an opening or closing of said valve, i.e. in order to tap the beverage said vale is opened, and closed if the handle is moved in the closing position. Preferably, a down movement of the handle opens the valve and an up movement of the handle closes the valve of the beverage supply line or also called beverage supply tube.

A further embodiment of the present invention is related to a beverage dispensing device that receives a low-carbonate beverage containing paper based container according to the present invention.

The beverage dispensing device according the present invention has a housing, and a cage is located within the housing for receiving, securing and holding the beverage container according to the present invention in a prefixed position, wherein the beverage dispensing device comprises a tapping device for dispensing the beverage, and an external $CO_2$ source, said beverage container filled up with low-carbonate beverage being placeable in the housing and connectable with the tapping device.

In may be preferred that the housing functions as a chiller and/or the housing comprises an insulation.

However, insulation may be an alternative to active cooling if the beer is pre-cooled. The insulation of the closed beverage dispensing device according the present invention may be selected such, that it may keep the beverage temperature of a 500 ml filled paper based beverage container according to the present invention at 0° C. start temperature in a range of >0° C. to ≤6° C. for at least 3 hours at a room temperature of 23° C.

For reasons of hygiene the beverage delivering tube is led through the tapping device, so that beverage is not in direct contact with the tapping device as such. The tapping device may have an opening that has a larger diameter, preferably at least 10%, compared to the diameter of the beverage delivering tube. Further, the tapping device may have a top cover that can be opened to facilitate the insertion of the beverage delivering tube. As an alternative, the tapping device may have a channel that receives the beverage delivering tube.

The tapping device may comprise a handle. Moving down the handle leads to an opening of the beverage delivering tube and an up movement squeezes the beverage delivering tube tight and stops the beverage flow.

The beverage dispensing device according to the present invention may comprise a thermoelectric cooling unit. The thermoelectric cooling unit is preferably located within the housing of the beverage dispensing device. A preferred thermoelectric cooling unit can be a Peltier element.

However, the time necessary to cool the beverage in a beverage container may take some time, depending on the size of the container. For a 5 l container the time for cooling the beverage inside may take at least 1 hour.

Thus, in order to reduce the cooling time of the low-carbonate beverage it may be preferred that the beverage dispensing device according to the present invention comprises an ice water or cool water bath that is located within the housing for cooling the beverage container containing low-carbonate beverage.

According to the present invention, the beverage dispensing device may comprise a cooling fluid outlet. The cooling fluid is preferably water. The cooling fluid outlet may be arranged at a lower wall part of the beverage dispensing device, which facilitates the change of the cooling fluid. The cooling fluid outlet may be in the form of a water tap.

The closed beverage container according to the present invention contains a low-carbonate beverage. Thus, the pressure at about 50° C. is relatively low, so that there is no danger that the beverage container could be damaged if stored at said temperature.

However, by the time the beverage container is placed inside the beverage dispensing device and connected to the gas supply source, the concentration of the carbon dioxide of the low-carbonate beverage is increased when used. The benefit of the cage is that it can stabilize the container against break due to increased pressure inside the container. It may be preferred that the inner volume of the cage fits the beverage container according to the present invention, so that there is no space between the outer wall of the beverage container and the inner wall of the cage in order to stabilize the beverage container. This has the benefit that the carbonate ($CO_2$) concentration can be increased to the desired amount without a risk of the beverage container not being able to withstand the increased pressure. For example, the cage may have a movable lid so that the beverage container according to the present invention can be stabilized from all sides.

Further, the cage may have a bottom that is adjustable in height. This allows the use of beverage containers that differ in height, without amending the length of the gas supply tube and/or beverage delivering tube. Due to the liftable bottom, differences in height of beverage containers, i.e. in volume, within the housing can be eliminated.

BRIEF DESCRIPTION OF THE DRAWINGS

Additional details, features, characteristics and advantages of the object of the invention are disclosed in the dependent claims. The figures and the following description of the respective figures and examples show by way of example preferred embodiments of a frothing device according to the invention.

FIG. 1 shows a self supporting closed beverage container 1 of a paper based material 2 composed of a cardboard comprising a low-carbonate beverage, wherein at least one inner liquid sealant polymeric layer 4 is welded to the paper based material and the closed beverage container 1 comprises a beverage delivering tube 5 with a flexible outer section and a rigid section inside the beverage container 1. On top of said beverage container is a beverage outlet opening 6, through which a lower rigid part 7 of said beverage delivering tube 5 extends to the bottom 8 of the inner beverage container 1 and the upper flexible part of the tube extends outwards 9. The use of a beverage delivering tube that has a rigid internal section that extends to the bottom has the advantage, that most of the beverage can be pumped out. However, it is also possible to use a beverage tube that is completely flexible. The beverage container 1 further comprises at least one gas pressure inlet opening 10. The beverage container 1 in an empty stage can be folded by hand. In order to facilitate the folding process the paper based beverage container can be prefolded and/or welded. The beverage can be delivered through the beverage delivering tube 5 due to gas pressure fed into the beverage container 1. The tube 5 is connected with the beverage container 1 in a gas and liquid tight manner, so that beverage cannot leak from the beverage outlet opening 6 of the beverage container 1.

Figure 2:
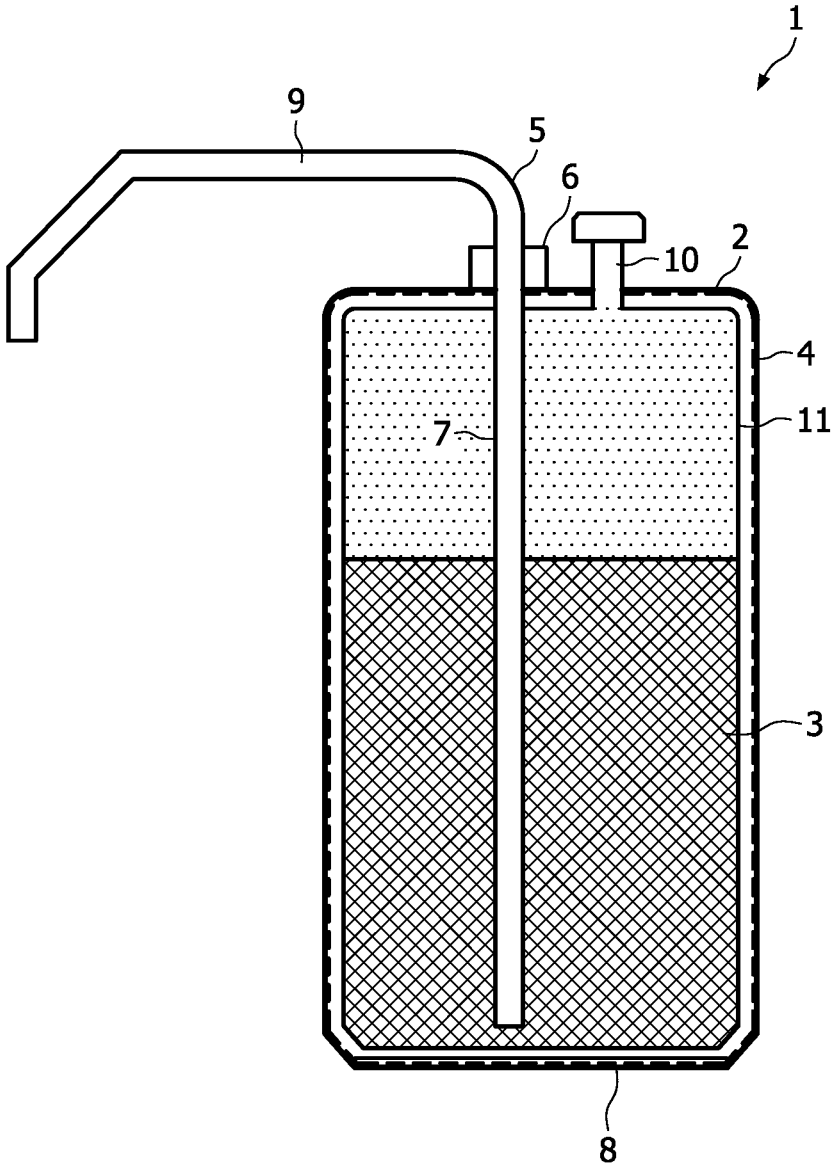
FIG. 2 is a self supporting closed beverage container according to the present invention that contains an inner bag for holding a beverage.

FIG. 2 shows a self supporting closed beverage container 1 of a paper based material 2 composed of a carton as shown in FIG. 1 with the difference, that the beverage container 1 contains an inner bag 11 for holding a beverage. This inner bag 11 has a deformable wall part which is compressible, for dispensing beverages from the container upon deformation of the flexible wall part caused by gas pressure produced by pressure means 15. The gas pressure inlet opening 10 is located in the middle on top of the beverage container 1. This has the benefit that the gas pressure inlet opening has a defined position and the container need not be adjusted to a predetermined position. For example, the adapter of the gas pressure source line 19 can be arranged in the cover lid of the beverage dispensing device 12 at a defined position, so that the adapter of the gas pressure source engages gas and liquid lines at the gas pressure inlet opening 10 of the beverage container 1 at the time the cover lid of the beverage dispensing device 12 is closed. As an alternative, the adapter of the gas pressure source 15 can be arranged in a component part of the tapping device that runs to the middle of the top of the paper based beverage container. The position of the beverage outlet opening 6 through which the beverage delivering tube 5 extends can be arranged near the gas pressure inlet opening 10. The flexible beverage delivering tube 5 has to be led through the tapping device, so that a defined adjustment with respect to the position of the beverage outlet opening 6 is not decisive. However, the length of the flexible beverage delivering tube 5 needs to be long enough. It may be preferred that the outer end of the flexible beverage delivering tube 5 is rigid and has an arch-like design. This allows a defined adjustment in the outer end of the tapping device, which is formed respectively to receive the end of the beverage delivering tube 5. The flexible part of the beverage delivering tube 5 can be slackly arranged inside the beverage dispensing device 12.

Figure 3:
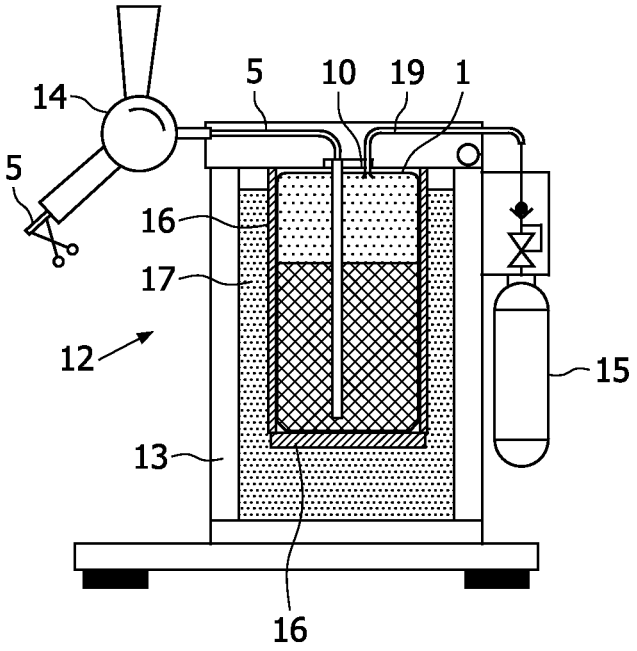
FIG. 3 is a beverage dispensing device with a housing for receiving a beverage containing beverage container according to the present invention.

FIG. 3 shows a beverage dispensing device 12 with a housing 13 for receiving a beverage containing beverage container 1 according to present invention, wherein the beverage dispensing device 1 comprises a tapping device 14 for dispensing beverage and an external $CO_2$ source 15. Further, a cage 16 is located within the housing 13 for receiving, securing and holding the beverage container 1 according to claims 1 to 10 in a prefixed position. The gas pressure inlet opening 10 is connectable with the gas pressure source 15, in so far as the gas pressure inlet opening 10 receives a gas tube 19, through which gas, preferably carbon dioxide, can be fed from a gas source 15. The beverage delivering tube 5 can be led through the tapping device 14, so that beverage is not in direct contact with the tapping device as such. The housing 13 functions as a chiller. For example, inside the housing an ice-bath 17 can be located to improve and fasten the cooling of the beverage. A chiller plate has the drawback that the time for cooling the beverage to the desired temperature of about 0° C. to 6° C. takes too long compared to a ice-bath that surrounds the beverage container according to the present invention. The beverage dispensing device 12 has a cooling fluid outlet opening (not shown) at a lower wall part section of the beverage dispensing device 12 to facilitate a change of the cooling fluid, such as water.

Figure 4:
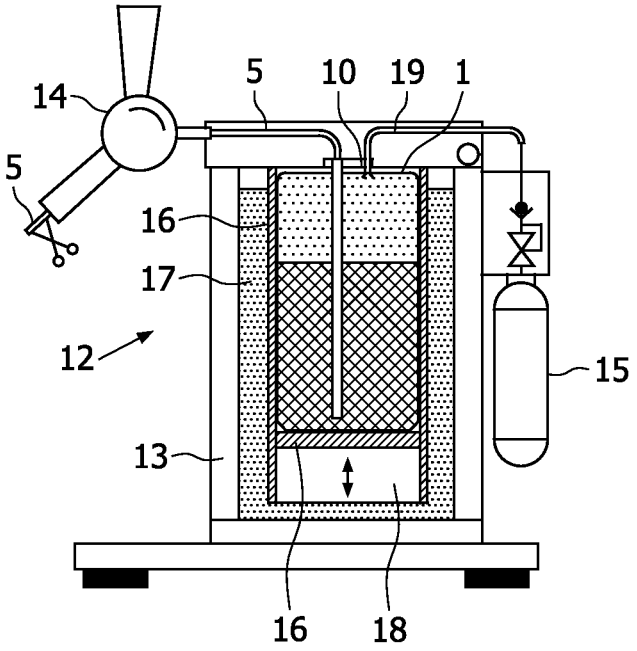
FIG. 4 is a beverage dispensing device with a cage that has an adjustable bottom.

FIG. 4 shows a beverage dispensing device 12 as shown in FIG. 3 with the difference that the cage 16 has an adjustable bottom 18, so that a difference in height of a beverage container 1 can be smoothed away within the housing 13.

The particular combinations of elements and features in the above detailed embodiments are exemplary only; the interchanging and substitution of these teachings with other teachings in this and the patents/appliances incorporated by reference are also expressly contemplated. As those skilled in the art will recognize, variations, modifications, and other implementations of that which is described herein may occur without departing from the spirit and scope of the invention as claimed. Accordingly, the above description is by way of example only and is not intended to be limiting. The scope of the invention is defined in the following claims and the equivalents thereto. Furthermore, reference signs used in the description and claims do not limit the scope of the invention as claimed.

The invention claimed is:

1. A self-supporting paper-based beverage container comprising:

an inner surface covered by at least one liquid-sealing polymeric layer for sealing the self-supporting container against leakage when filled;

and said container further comprising:

a beverage outlet opening;

a beverage-delivery tube extending from inside the beverage container and through the beverage outlet opening to an end external of the container for connection to a tap, said tube being sealably attached to the container and being closed at said end when the container is filled;

a sealable gas pressure inlet opening connected through a gas tube to a gas-pressure source, said inlet opening allowing a gas to enter said container to pressurize the container, said tap including a valve controlling:

application of said gas from said gas pressure source to said beverage-delivery tube to carbonate said beverage to a concentration suitable for consumption, and dispensing of said carbonated beverage through said beverage-delivery tube.

2. The beverage container as claimed in claim 1 where the beverage contained in the beverage container comprises a low-carbonate beverage with a $CO_2$ concentration within a range of 0 g/l to 1.5 g/l.

3. The beverage container as claimed in claim 1 where the polymeric layer comprises a polyolefinic polymer layer.

4. The beverage container as claimed in claim 1, where said self-supporting beverage container is collapsible when empty.

* * * * *